US006892914B2

(12) United States Patent
Girbert

(10) Patent No.: US 6,892,914 B2
(45) Date of Patent: May 17, 2005

(54) CARRIER FOR BATTERY POWERED TOOLS

(76) Inventor: Aaron Girbert, 525 Stanton Ave., Springfield, OH (US) 45503

( * ) Notice: Subject to any disclaimer, the term of this patent is extended or adjusted under 35 U.S.C. 154(b) by 19 days.

(21) Appl. No.: 10/200,410

(22) Filed: Jul. 22, 2002

(65) Prior Publication Data

US 2003/0173391 A1 Sep. 18, 2003

Related U.S. Application Data

(60) Provisional application No. 60/364,375, filed on Mar. 14, 2002.

(51) Int. Cl.[7] ..... A45F 3/02

(52) U.S. Cl. ..... 224/625; 224/663; 224/904

(58) Field of Search ..... 224/625, 640, 224/647, 648, 663, 904, 912, 930

(56) References Cited

U.S. PATENT DOCUMENTS

| | | | | | |
|---|---|---|---|---|---|
| 1,383,315 | A | | 7/1921 | Lethern | |
| 1,781,162 | A | | 11/1930 | Clark | |
| 1,884,328 | A | | 10/1932 | Sperling | |
| 2,037,132 | A | | 4/1936 | Hoyt | |
| 2,089,402 | A | | 8/1937 | Murray | |
| 2,109,232 | A | * | 2/1938 | Hoyt | 224/193 |
| 2,146,570 | A | | 2/1939 | Gordon | |
| 2,396,118 | A | | 3/1946 | Oldemeyer | |
| 2,579,782 | A | | 12/1951 | Booth | |
| 2,620,479 | A | | 12/1952 | Buck | |
| 3,074,250 | A | | 1/1963 | Everett | |
| D214,560 | S | | 7/1969 | Kassel | |
| 3,739,961 | A | | 6/1973 | Soukeras | |
| D234,840 | S | | 4/1975 | Adams | |
| 4,262,832 | A | | 4/1981 | Perkins | |
| 4,346,827 | A | | 8/1982 | Bianchi et al. | |
| 4,580,707 | A | | 4/1986 | Shoemaker | |
| 4,721,238 | A | | 1/1988 | Shoemaker | |
| D294,198 | S | | 2/1988 | Collins | |
| 4,750,652 | A | | 6/1988 | Grant | |
| 4,785,983 | A | | 11/1988 | DeSantis | |
| 4,828,154 | A | * | 5/1989 | Clifton, Jr. | 224/661 |
| 4,903,874 | A | | 2/1990 | Shoemaker | |
| 4,917,281 | A | | 4/1990 | Ostermiller | |
| 4,953,767 | A | * | 9/1990 | Bennett | 224/192 |
| 5,246,153 | A | | 9/1993 | Beletsky | |
| 5,263,618 | A | | 11/1993 | Talavera | |
| 5,358,159 | A | | 10/1994 | Lundie, Jr. | |
| 5,361,953 | A | | 11/1994 | Nichols | |
| 5,775,558 | A | | 7/1998 | Montalbano | |
| 5,984,046 | A | * | 11/1999 | Urso, Jr. | 182/129 |
| 6,016,944 | A | | 1/2000 | Girbert | |
| 6,065,658 | A | * | 5/2000 | Hashimoto | 224/647 |
| 6,561,402 | B2 | * | 5/2003 | Holland et al. | 224/677 |
| 6,568,575 | B1 | * | 5/2003 | Bartholomew | 224/583 |

* cited by examiner

*Primary Examiner*—Stephen K. Cronin
(74) *Attorney, Agent, or Firm*—B. Craig Killough

(57) ABSTRACT

A tool carrier for battery powered tools that properly positions a battery powered tool that uses a heavy battery on the body of a wearer. The tool carrier has a rigid spine that is positioned behind one or more pockets extending from the tool carrier. The pockets retain the tool within the battery powered tool carrier when the tool is not in use. The device is suspended from one or more harnesses. The battery powered tool carrier properly balances the tool so that it is easy to carry and is properly secured within the battery powered tool carrier, yet it is easy to remove from, and insert into, the battery powered tool carrier.

15 Claims, 7 Drawing Sheets

CARRIER FOR BATTERY POWERED TOOLS

This application claims priority on provisional application Ser. No. 60/364,375 filed Mar. 14, 2002.

FIELD OF THE INVENTION

This invention relates to devices for transporting tools, and is specifically directed to a carrier for battery powered tools that may be worn.

BACKGROUND OF THE INVENTION

Construction workers and other craftsmen use many tools as they perform their duties. Tools have become increasingly transportable, since battery powered tools are now common use. Battery power allows the portability of power tools without the necessity of extension cords. Accordingly, a worker using a power tool has substantial freedom of movement.

Workers who work at heights, or far from a toolbox, need a device for transporting tools, parts and accessories used to perform their duties. It is not convenient or efficient to climb to a work place, and to frequently climb down to retrieve a tool or other equipment.

To facilitate freedom of movement, tool carriers for power tools have been provided. Tool carriers allow the worker to store the tool on his or her person, allowing both hands of the worker to be free as necessary. Tool belts are also in use, but these belts position the tools on the wearer such that the belt or the tools snag other objects, presenting a safety hazard to the user, particularly while climbing or working around machinery.

Tool carriers and tool belts in the prior art have not achieved optimum utility. The placement of a tool carrier on, or around, the waist of a user, such as by a belt, is not satisfactory. The tool carrier is frequently interferes with the use, and may catch or snag during movement, such as climbing. The safety of the user is therefore compromised. The carrier for such tools and parts must not compromise the safety of the worker who is climbing or maneuvering in tight quarters. The carrier must be positioned so as to not catch on other articles as the user climbs or maneuvers. The carrier should have versatility to carry various articles.

Power tools have become increasingly powerful. More powerful tools require more powerful batteries, which are very heavy. Some electrically powered tools in common use have large 24-volt batteries, that are typically mounted in the handle of the tool. These large batteries affect the overall weigh and balance of the tool and battery assembly.

Tool carriers known in the art do not account for the battery weight that is added to the tool. The positioning of the tool in the battery powered tool carrier, and the positioning of the battery powered tool carrier on the operator becomes more critical with tools having heavy batteries, due to the weight and balance considerations.

The tool carrier must be durable, since it is exposed to rugged and difficult environmental conditions during use. Professional users will use the tool carrier eight or more hours a day, and on a daily basis, over an extended period of time.

The tool must be easily inserted into the battery powered tool carrier, and easily remove, but must be securely retained within the tool carrier. If the tool falls from the battery powered tool carrier, it could cause injury to a user, or someone who is below the user.

SUMMARY OF THE PRESENT INVENTION

The present invention provides a tool carrier for battery powered tools that properly positions a battery powered tool that uses a heavy battery. The tool carrier has a rigid spine. The tool carrier has pockets extending from it for retaining the tool within the battery powered tool carrier. The device is suspended from one or more harnesses. The battery powered tool carrier properly balances the tool so that it is easy to carry and is properly secured within the battery powered tool carrier, yet it is easy to remove from, and insert into, the battery powered tool carrier.

DESCRIPTION OF THE PREFERRED EMBODIMENT

Figure 1:
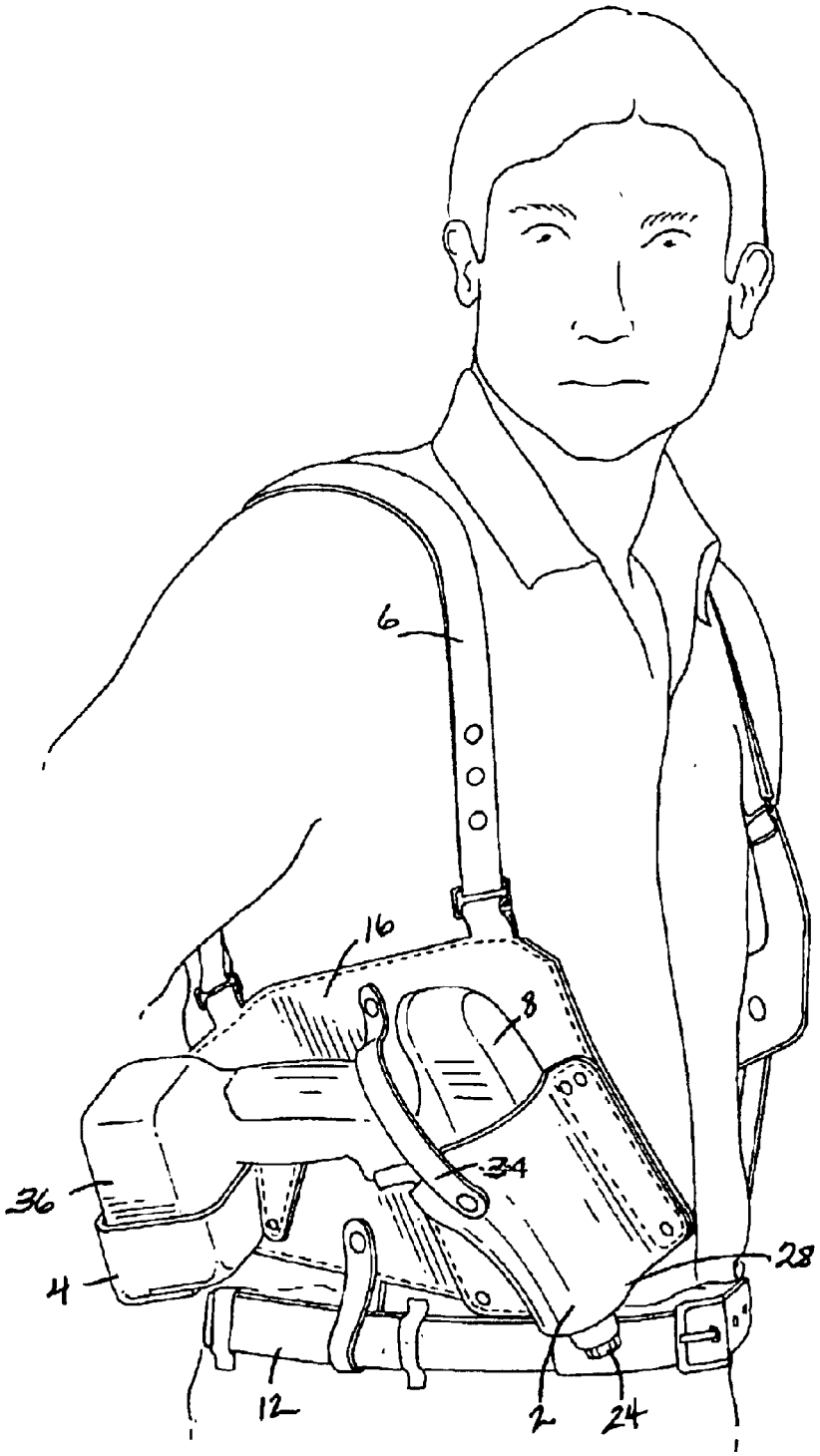
FIG. 1 is a perspective view of the battery powered tool carrier as worn by a user.
Figure 2:
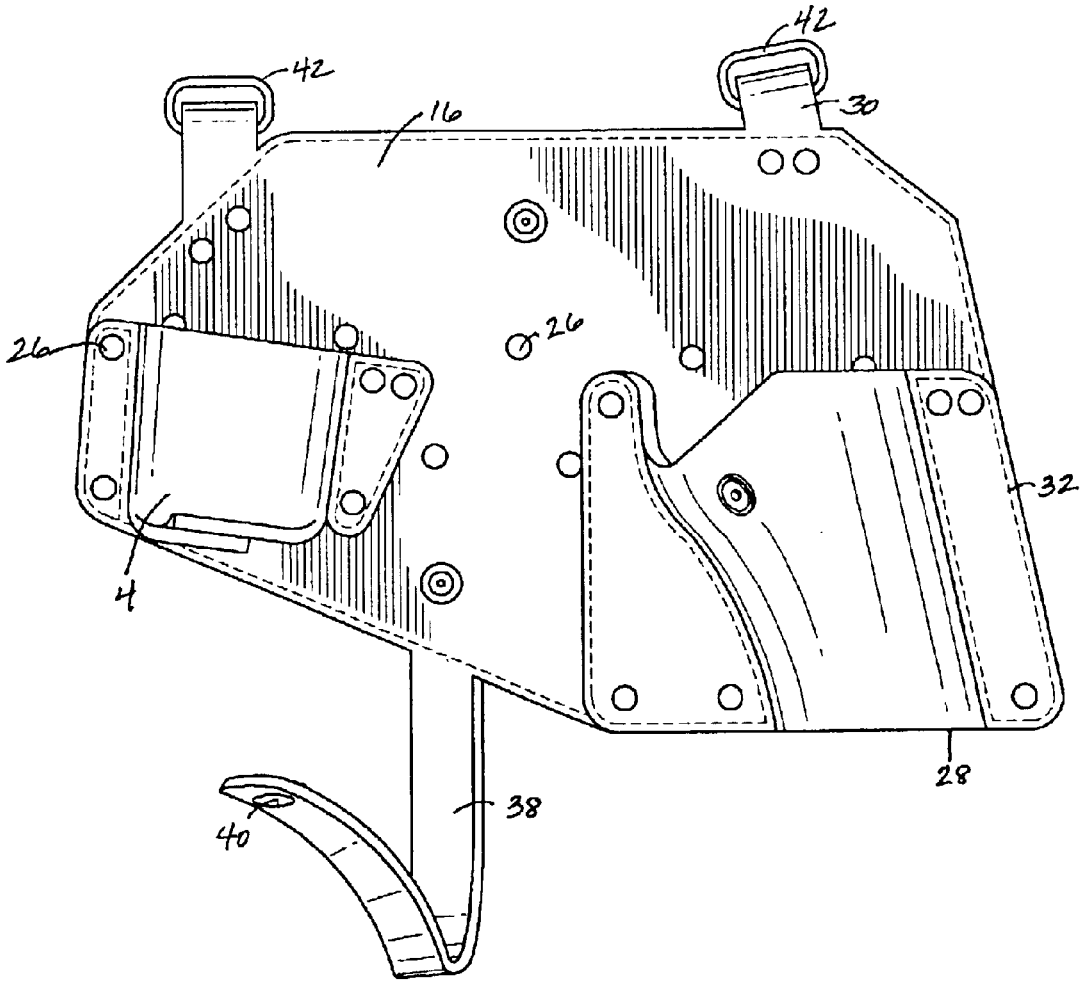
FIG. 2 is a side elevation the battery powered tool carrier.

Referring now to the drawing figures. FIG. 1 shows the carrier as having a first pocket 2 and a second pocket 4. The carrier is suspended from a harness 6 worn over one shoulder of the user. A second harness may be used and may be worn over the opposite shoulder of the user.

The first pocket is formed for receiving one end of a power tool 8 and is positioned on the harness. The first pocket has an opening 10 that receives the end of the tool in which the motor of the tool is contained, while the handle, or a portion of the handle, of the tool is outside of the first pocket. The second pocket 4 is formed for receiving the end of the power tool 8 in which the battery is positioned.

The carrier is positioned underneath the arm of the user, and relatively high on the torso, for maximum convenience and weight balance. The opening 10 of the pocket that receives the tool is generally vertical, but is on a slight angle, so that the pouch is oriented to receive and hold the tool within the pouch. The carrier may be worn lower, such as on a belt 12 the one shown in FIG. 1, and the carrier will still be balanced with the tool present, although most users will prefer to wear the carrier higher on the torso. The tool may be positioned by adjusting the harness, so that the tool is positioned according to the wearer's preference.

Figure 6:
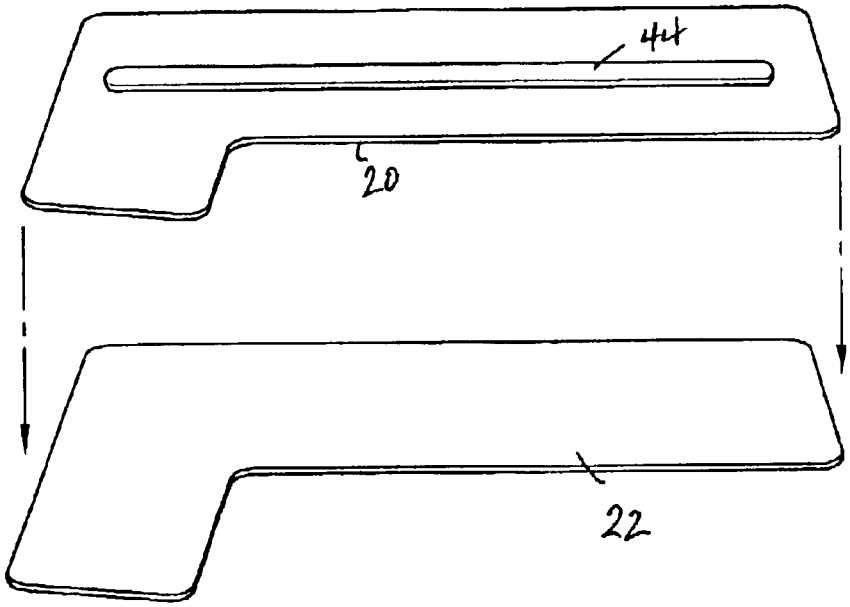
FIG. 6 is an exploded view of the two-ply rigid spine of the battery powered tool carrier.
Figure 7:
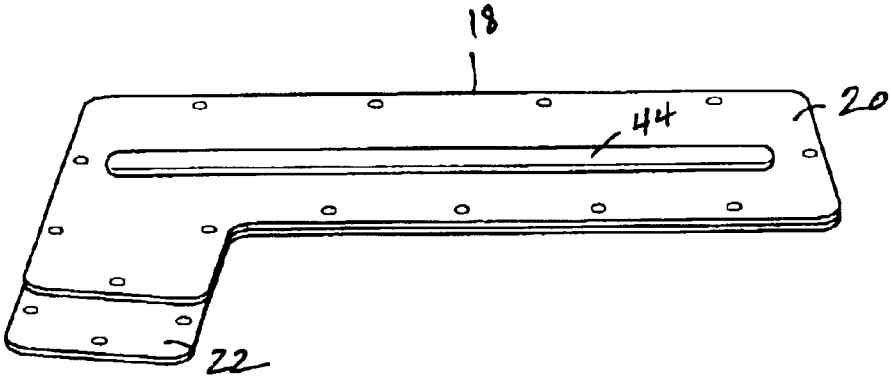
FIG. 7 is an isolation of the two-ply rigid spine of the battery powered tool carrier.
Figure 8:
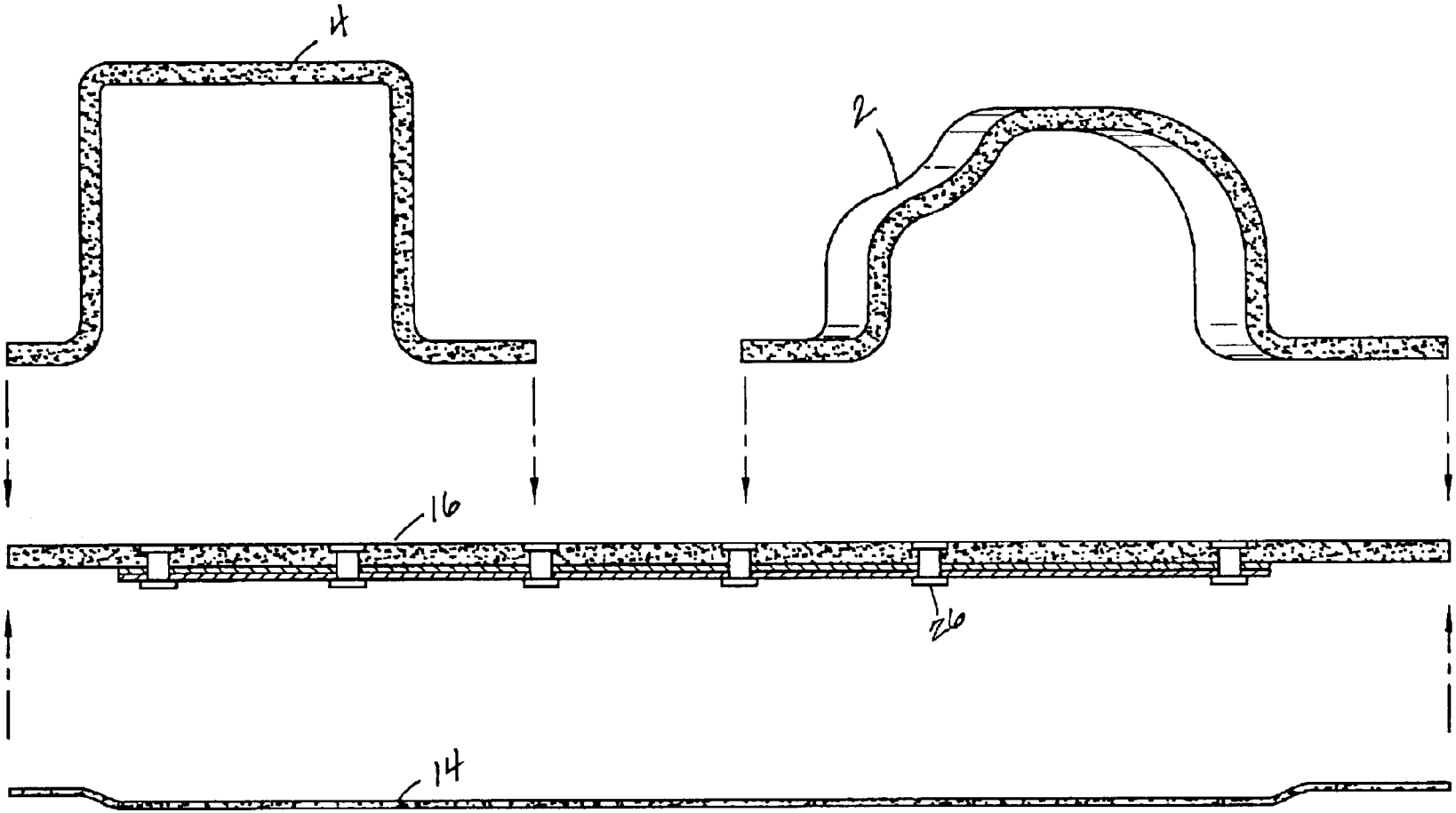
FIG. 8 is an exploded, sectioned view of the battery powered tool carrier.

As shown in FIG. 8, the major components of the device are an inner ply of material 14, an outer ply of material 16, a rigid spine 18, a first pocket 2 and a second pocket 4. The rigid spine may be comprised of two layers 20, 22 of material. FIG. 6; FIG. 7. Fasteners 26 may be used to hold the rigid spine in place relative to the outer ply of material. The inner ply of material is attached to the outer ply of material. The first pocket and second pocket are attached to the outer ply of material, opposite the inner ply of material.

The first pocket is formed to accept the end of a drill or similar battery powered tool. The second pocket is formed to accept the battery of the battery powered tool. Typically, the power take off, such as the chuck 24 of a drill, extends through a lower opening 28 in the first pocket, while the end of the motor housing that is opposite the chuck, extends through an upper opening of the pocket. The first pocket is positioned underneath a harness attachment point 30, and near one side of the outer ply of material. The pocket is fixed in place on the outer ply of material. The pocket may be fixed in place on the outer ply of material by stitching 32, and may be further fixed to the outer ply and the spine by rivets 26 or similar fasteners. A retaining strap 34 may be used to connect the outer ply of material to the pocket, and to bridge the top opening 10 of the pocket to hold the power tool in place within the pocket.

The second pocket is formed to accept a lower end 36 of a handle of a battery powered tool. In particular, the second pocket is formed to accept the lower end of the handle of a battery-powered tool that has a relatively large and heavy battery positioned in the handle. The second pocket is positioned underneath a harness attachment point. The second pocket is positioned near one edge of the outer ply of material. The second pocket may be attached to the second ply of material, such as by stitching, or other means. The second pocket may be affixed to the outer ply of material and to the spine by fasteners, such as rivets.

A strap 38 extends from a lower portion of the carrier. The strap may be connected to a wearer's belt. The strap may have a snap 40 or similar fastener that joins to the outer ply of material. The upper portion of the carrier has a first connecting point and a second connecting point. The harness attachment points may have D rings 42, or similar rings, or other known attachment means for connecting the carrier to the harness 6.

The inner ply of material is preferred to have a smooth surface. No fastener or other object should protrude from the surface of the inner ply, since it is worn next to the user, and since objects protruding from the inner ply could present discomfort to the wearer.

FIGS. 6 and 7 show the rigid spine of the device in isolation. The rigid spine maintains the structural integrity of the carrier. The rigid spine is construed of a rigid material, and is preferred to be a non-corrosive material. 414 stainless steel could be used. Fiberglass or other rigid materials could be used. In the embodiment of the invention as shown in the drawings, two layers of stainless steel are used, with at least one layer having a raised rib 44 for increased strength. The rigid spine is preferred to be an "L" shaped plane, having a raised rib. The first layer and second layer of the spine of the preferred embodiment are welded together by a welding process that is suitable to the materials being welded, such as electrical spot welding in case of certain metals. One leg of the "L" shaped layer extends below the leg of the other "L" shaped layer of the rigid spine.

In the embodiment demonstrated in FIG. 8, the rigid spine is held in place relative to the outer ply of material by rivets 26. Other fasteners could be used. In one embodiment of the invention, the outer ply is formed of leather, and rivets are suitable for holding the spine in place against the leather outer ply. The outer ply may be formed of other materials, and other means for holding the rigid spine could be used. The outer ply of material may be leather having a thickness of at least ⅛ inch, and the pockets may be formed of leather that is at least ⅛ inch thick, so that the pockets maintain their shape. Alternatively, the pockets could be formed of other materials which are resilient, but which retain their shape, such as plastic. The pockets could be formed of plastic and covered with a material such as leather or a sheet of puncture resistant material, such as an appropriate plastic material.

Figure 3A:
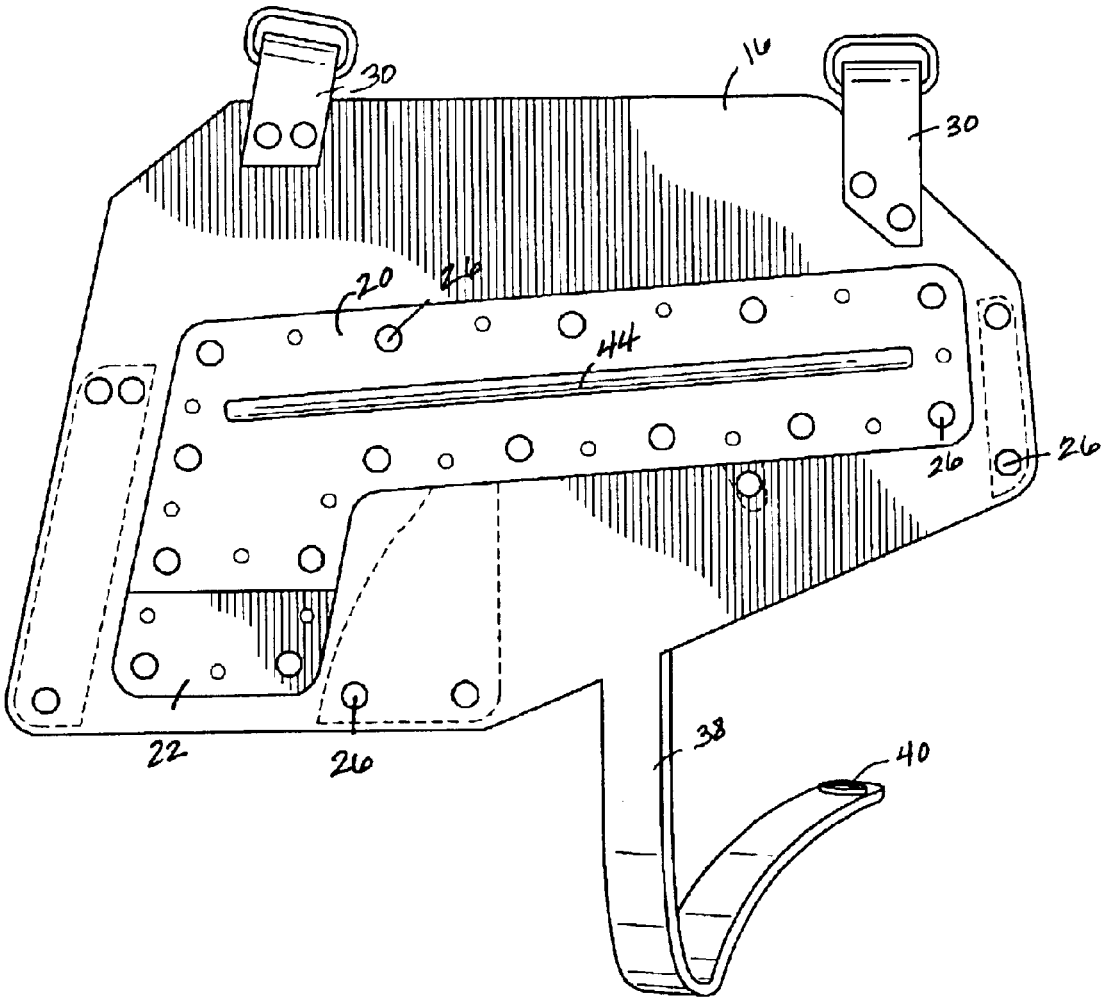
FIG. 3A is a side elevation of an interior of the battery powered tool carrier.
Figure 3B:
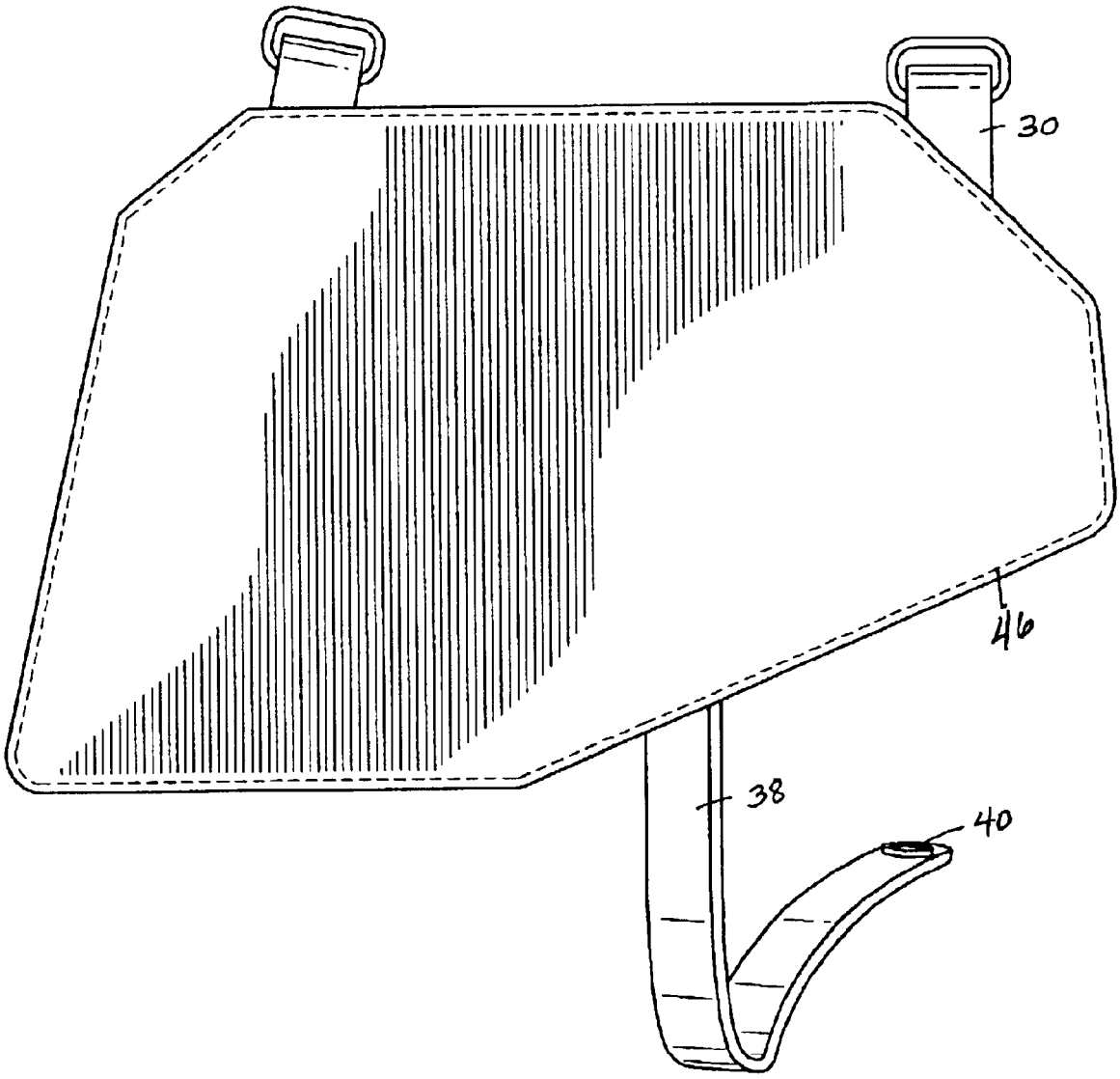
FIG. 3B is a side elevation the battery powered tool carrier showing the side that is opposite the side shown in FIG. 2.
Figure 4:
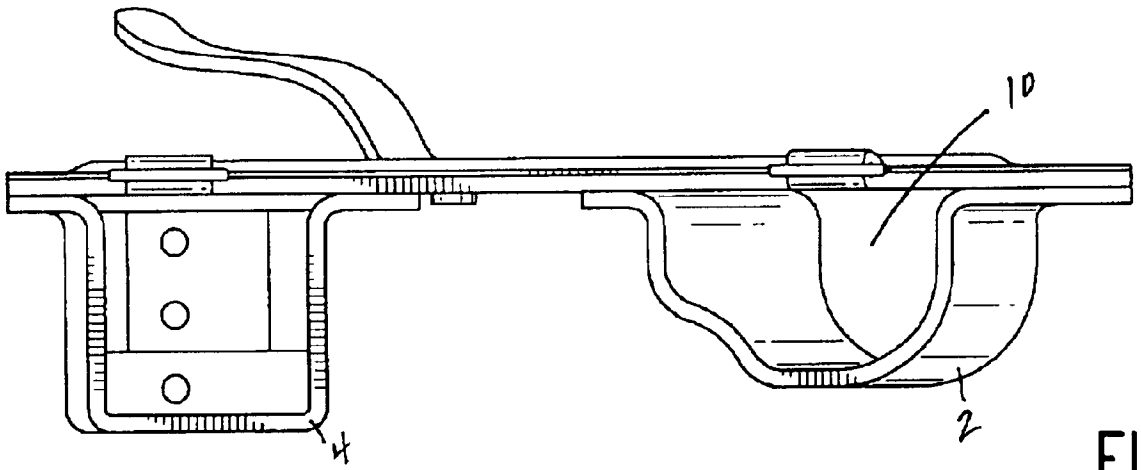
FIG. 4 is a top plan view of the battery powered tool carrier.
Figure 5:
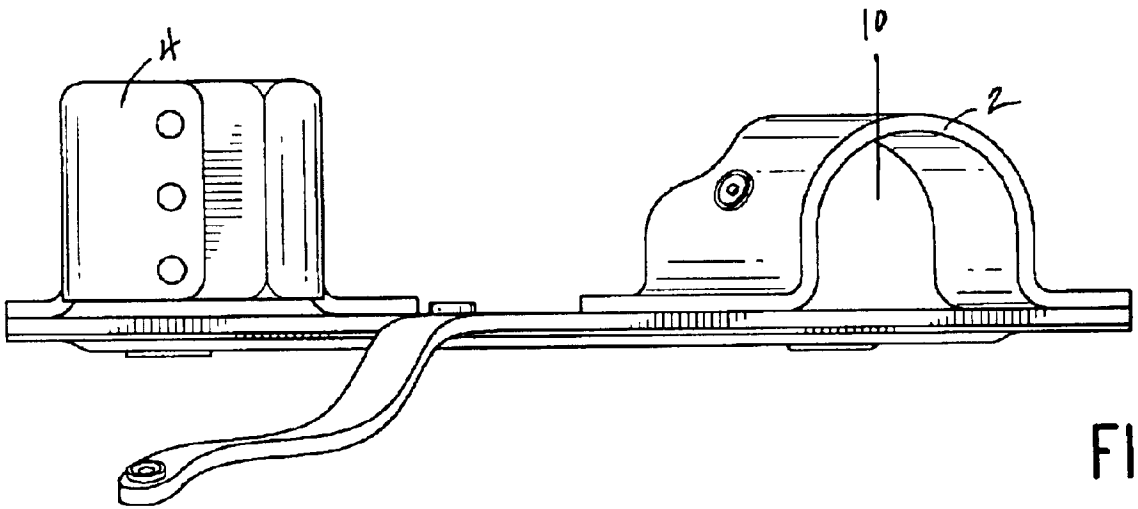
FIG. 5 is a bottom plan view of the battery powered tool carrier.

The "L" shaped rigid spine of one embodiment is positioned relative to the first pocket as demonstrated by FIG. 3A. The "L" shaped rigid spine is positioned behind the battery-powered tool, when the battery-powered tool is present in the carrier. The shorter leg of the "L" extends downwardly, and generally vertically, as shown in FIG. 3A, so that the shorter leg is effectively behind the first pocket. The opposite, and longer, leg of the "L" extends generally horizontally and aftwardly, and away from the first pocket, and towards the second pocket, so that it provides a backing for the handle of the power tool, as well as providing a backing for the second pocket near one end of the longer leg of the "L" that is opposite the shorter leg of the "L". The rigid "L" shaped spine maintains the integrity of the shape of the carrier, and also provides a rigid member that is present between the tool and the wearer's body. The different thicknesses of the rigid spine, which may be achieved by the two layer formation of one embodiment of the rigid spine, provides additional thickness for the spine at the upper position, but is thinner at the lower portion, near the perimeter of the first ply and second ply, where the first and second ply are stitched 46 together. As shown in the preferred embodiment, rivets are used to join the first pocket to the outer ply of material, and rivets are used to join the second pocket to the outer ply of material. Other durable fastening means could be used.

The rigid spine prevents the tool carrier from deforming. The pockets are provided with support and backing by the spine, and the rigid spine presents superior shape retention characteristics for the pockets. Further, the force of the tool against the wearer's body is diffused by means of the spine, so that, for example, a point of the tool that is protruding does not constantly pound one area of the wearer's body over the course of a day of use. The separate battery pocket of the preferred embodiment reduces carrier wear that results from movement of the tool. The rigid spine keeps the pockets in proper position relative to each other, which also minimizes wear, as well as assuring proper balance of the carrier with the tool in place.

What is claimed is:

1. A wearable tool carrier, comprising:

a. an inner layer of material;

b. an outer layer of material;

c. a pocket that extends from said outer layer of material, said pocket being configured for receiving a battery powered tool;

d. a rigid spine that is positioned between said inner layer of material and said outer layer of material; and e. a second pocket configured for receiving a battery containing handle of the battery powered tool, wherein said second pocket extends from said outer layer of material.

2. A wearable tool carrier as described in claim 1, wherein said rigid spine is present behind said pocket and said second pocket, and said rigid spine is present behind and bridges an area between said first pocket and said second pocket.

3. A wearable tool carrier as described in claim 1, wherein said pocket has a generally vertical opening for receiving said battery powered tool, and wherein said rigid spine has a generally vertical leg that is present behind said generally vertical opening of said pocket, and wherein said rigid spine has a generally horizontal leg that is present above said generally vertical leg and intersects said generally vertical leg, and said generally horizontal leg extends aftwardly from said generally vertical leg.

4. A wearable toot carrier as described in claim 3, wherein said generally vertical portion of said rigid spine does not have a uniform thickness.

5. A wearable tool carrier as described in claim 1, wherein said pocket has a generally vertical opening for receiving said battery powered tool, and wherein said rigid spine has a generally vertical leg that is present behind said generally vertical opening of said pocket, and wherein said rigid spine has a generally horizontal leg that is present above said generally vertical leg and said generally horizontal leg extends aftwardly from said generally vertical leg, and wherein at least a portion of an end of said generally horizontal leg that is opposite said generally vertical leg is behind said second pocket.

6. A wearable tool carrier as described in claim 5, wherein said generally vertical portion of said rigid spine does not have a uniform thickness.

7. A wearable tool carrier, comprising:

a. an inner layer of material;

b. an outer layer of material;

c. a pocket that extends from said outer layer of material, said pocket being configured for receiving a battery powered tool; and d. a rigid spine that is positioned between said inner layer of material and said outer layer of material, wherein said rigid spine comprises a first layer and a second layer.

8. A wearable tool carrier as described in claim 7, wherein said rigid spine does not have a uniform thickness.

9. A wearable tool carrier, comprising:

a. an inner layer of material;

b. an outer layer of material;

c. a pocket that extends from said outer layer of material, said pocket being configured for receiving a battery powered tool; and d. a rigid spine that is positioned between said inner layer of material and said outer layer of material, wherein said rigid spine does not have a uniform thickness.

10. A wearable tool carrier, comprising:

a. an inner layer of material;

b. an outer layer of material;

c. a pocket that extends from said outer layer of material, said pocket being configured for receiving a battery powered tool;

d. a rigid spine that is positioned between said inner layer of material and said outer layer of material, and wherein substantially all of a portion of said inner layer that is behind said battery powered tool is generally planar.

11. A wearable tool carrier, comprising:

a. an inner layer of material;

b. an outer layer of material;

c. a packet that extends from said outer layer of material, said pocket being configured for receiving a battery powered tool;

d. a rigid spine that is positioned between said inner layer of material and said outer layer of material; and wherein substantially all of a portion of said outer layer that is adjacent to said battery powered tool is generally planar.

12. A wearable tool carrier, comprising:

a. an inner layer of material;

b. an outer layer of material;

c. a pocket that extends from said outer layer of material, said pocket being configured for receiving a battery powered tool; and d. a rigid spine that is positioned between said inner layer of material and said outer layer of material, wherein said rigid spine is generally planar.

13. A wearable tool carrier as described in claim 12, wherein said rigid spine does not have a uniform thickness.

14. A wearable tool carrier as described in claim 13, wherein said inner layer is of sufficient size to prevent contact of said battery powered tool that is located in said pocket with a user that is wearing said wearable tool carrier.

15. A wearable tool carrier, comprising:

a. an inner layer of material;

b. an outer layer of material;

c. a pocket that extends from said outer layer of material, said pocket being configured for receiving a battery powered tool;

d. a rigid spine that is positioned between said inner layer of material and said outer layer of material, and wherein said inner layer is of sufficient size to prevent contact of said battery powered tool with a user that is wearing said wearable tool carrier.

* * * * *